US006375066B1

(12) United States Patent
Ritter

(10) Patent No.: US 6,375,066 B1
(45) Date of Patent: Apr. 23, 2002

(54) REDUCIBLE CARTON FOR PIZZA PIES AND THE LIKE

(75) Inventor: Karl M. Ritter, Geneva, IL (US)

(73) Assignee: Weyerhaeuser Company, Federal Way, WA (US)

( * ) Notice: Subject to any disclaimer, the term of this patent is extended or adjusted under 35 U.S.C. 154(b) by 0 days.

(21) Appl. No.: 09/797,888

(22) Filed: Mar. 1, 2001

Related U.S. Application Data

(60) Provisional application No. 60/186,254, filed on Mar. 1, 2000.

(51) Int. Cl.[7] ..... B65D 5/54
(52) U.S. Cl. ..... 229/101.2; 229/906; 229/107
(58) Field of Search ..... 209/101, 101.1, 209/101.2, 103, 107, 906

(56) References Cited

U.S. PATENT DOCUMENTS

| | | | | |
|---|---|---|---|---|
| 3,167,240 A | * | 1/1965 | Collura et al. | 229/101.2 |
| 3,310,220 A | * | 3/1967 | Feldman | 229/101.2 |
| 4,136,817 A | * | 1/1979 | Perry | 229/101 |
| 4,712,688 A | | 12/1987 | Lambert | |
| 4,817,803 A | | 4/1989 | Risucci | |
| 5,071,062 A | | 12/1991 | Bradley et al. | |
| 5,110,038 A | | 5/1992 | Pantisano et al. | |
| 5,305,949 A | | 4/1994 | Linden | |
| 5,669,493 A | | 9/1997 | Focke et al. | |
| 5,806,755 A | | 9/1998 | Correll | |
| 5,836,451 A | | 11/1998 | Dixon | |
| 5,881,948 A | | 3/1999 | Correll | |

* cited by examiner

*Primary Examiner*—Lee Young
*Assistant Examiner*—Tri M. Mai

(57) ABSTRACT

An improvement is provided for a pizza-style paperboard container. The improvement includes first and second separation lines extending through first and second lateral panels, respectively. An additional fold line is provided in the first lateral panel at a location rearward of the first separation line, the material therebetween defining a closure flap. The first lateral panel includes opposed side panels. These side panels include a pre-formed hinge. The second lateral panel also includes opposed side panels. As assembled, the side panels of the first lateral panel are exterior to the side panels of the second lateral panel. After the carton is first assembled in a conventional manner, it may be reduced in size by breaking the carton in two along the separation lines. The closure flap is then pushed inward while the hinges of the outer side panels capture the inner side panels.

18 Claims, 8 Drawing Sheets

REDUCIBLE CARTON FOR PIZZA PIES AND THE LIKE

CROSS-REFERENCE TO RELATED APPLICATION

This application claims priority to U.S. Provisional Application No. 60/186,254 filed Mar. 1, 2000, the benefit of which is hereby claimed under 35 U.S.C. 119(e).

FIELD OF THE INVENTION

The present invention relates to paperboard containers, and more particularly, to foldable one-piece containers for packaging and storing relatively flat food, such as pizza pies or the like.

BACKGROUND OF THE INVENTION

Takeout pizza is often not consumed in one sitting. There are usually leftovers which are kept in the box or stored in a separate container and put into a refrigerator. These are not optimal storage means, however. Wrapping and placing leftover pizza in a different container is messy, inconvenient, and wasteful. Likewise, using the pizza box itself for storage is difficult, due to the tight storage constraints of an average refrigerator.

Designers have attempted to produce reducible cartons for pizza pies by using full-sized pizza boxes that can be torn in two along prescored lines. See for example, U.S. Pat. No. 5,071,062. This patent describes a pizza container having a removable upper lid and a lower portion that is foldable upon itself to result in a reduced size storage container. This particular container, however, is difficult to use, since it requires the user to fold the lower portion along lines that may be saturated with food oil or covered with food bits.

Thus, a need exists for a reducible pizza carton that is easy to use. Ideally, the carton should initially have a traditional pizza box shaped with reducibility features that do not hamper its functionality in any way. The setup and strength of the container should not be affected by the reducibility features, either. In an optimal arrangement, the leftover pizza need only be shifted to one side of the box and the container reduced in size without having to remove the pizza from the box. This should also be accomplished without requiring the user to fold cardboard along complicated lines and/or lines likely to have been saturated with food. The present invention is directed to fulfilling these needs and others as described below.

SUMMARY OF THE INVENTION

In accordance with aspects of the present invention, an improvement is provided for a pizza-style paperboard container. The container is formed from a single-piece blank and includes a first lateral panel, first and second opposed side panels hingedly connected to the first lateral panel, a second lateral panel, and third and fourth opposed side panels hingedly connected to the second lateral panel. As assembled, the first and second lateral panels are generally parallel to one another. The side panels are orthogonal to the lateral panels. The third and fourth side panels are adjacent and inward of the first and second side panels, respectively.

The improvement is for reducing the assembled container into a smaller-sized container. The improvement includes first and second separation lines formed in the first and second lateral panels, respectively. An additional fold line is provided in the first lateral panel at a location rearward of the first separation line. The material therebetween defines a closure flap. The first and second side panels each include a pre-formed hinge. The second lateral panel also includes opposed side panels. After the carton is first assembled in a conventional manner, it may be reduced in size by breaking the carton in two along the separation lines. The closure flap is then pushed inward while the hinges of the outer first and second side panels capture the inner third and fourth side panels, respectively.

In accordance with other aspects of this invention, the height of the closure flap is generally greater than the height of the side panels, so that the closure flap is at a forwardly oriented angle when closed.

An alternative embodiment is described in which the hinges may be eliminated and the closure flap is made to frictionally engage the second lateral panel. This is accomplished by forming the separation line of the closure flap in an forwardly arcuate shape and forming the fold line in a rearwardly arcuate shape. To reduce the assembled container into a smaller-sized container, the user breaks the container along the separation lines and the closure flap is folded along the fold line. The forwardly arcuate shape of the closure flap frictionally engages the second lateral panel, while portions of the inner third and fourth side panels are captured between the edges of the closure flap and the outer first and second side panels, respectively.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 5B:
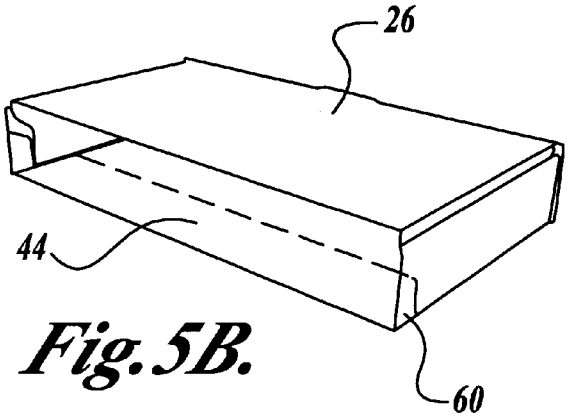
FIGS. 5A, 5B, 5C, and 5D are perspective views illustrating forming of the reduced container of FIG. 2.
Figure 5D:
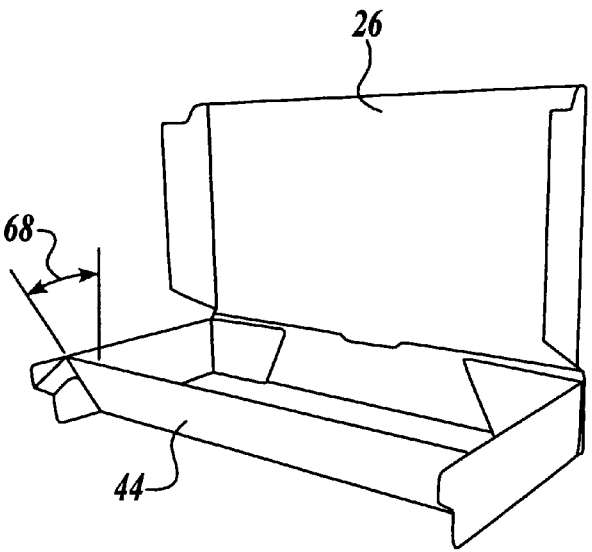
Figure 5A:
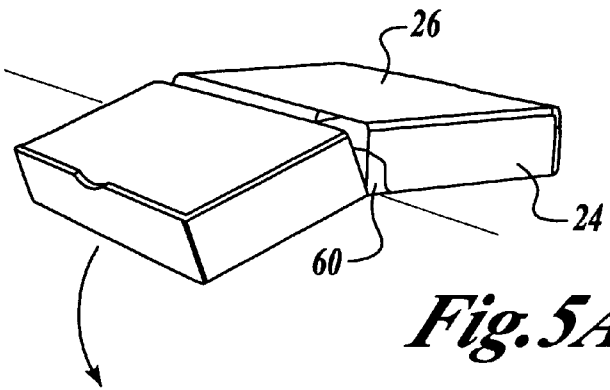
Figure 5C:
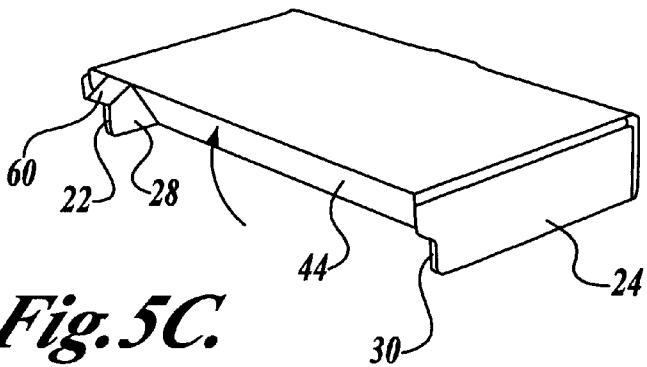
Figure 6:
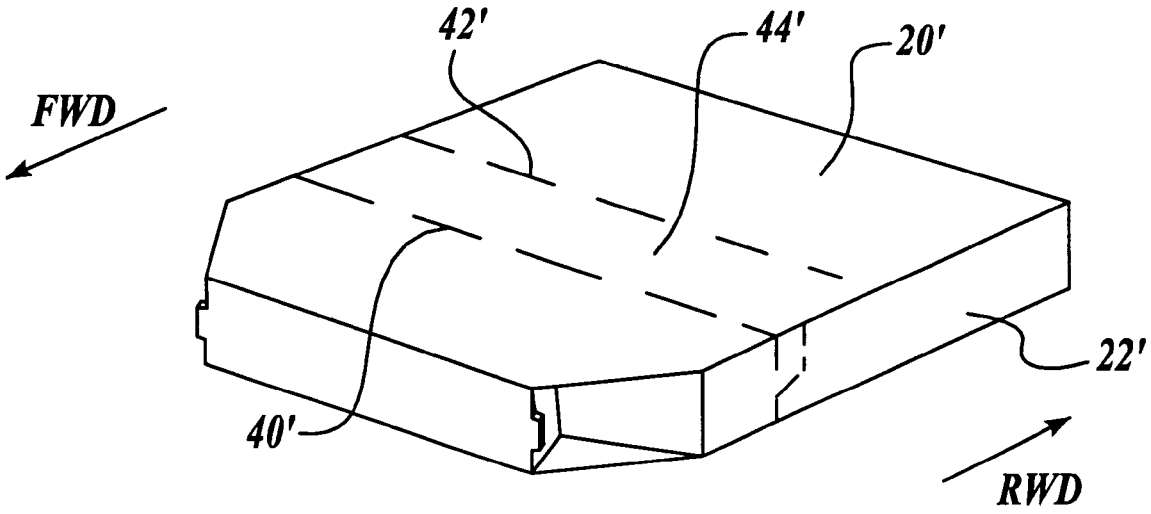
FIG. 6 is a perspective view of a second embodiment of a container formed in accordance with the present invention.
Figure 7:
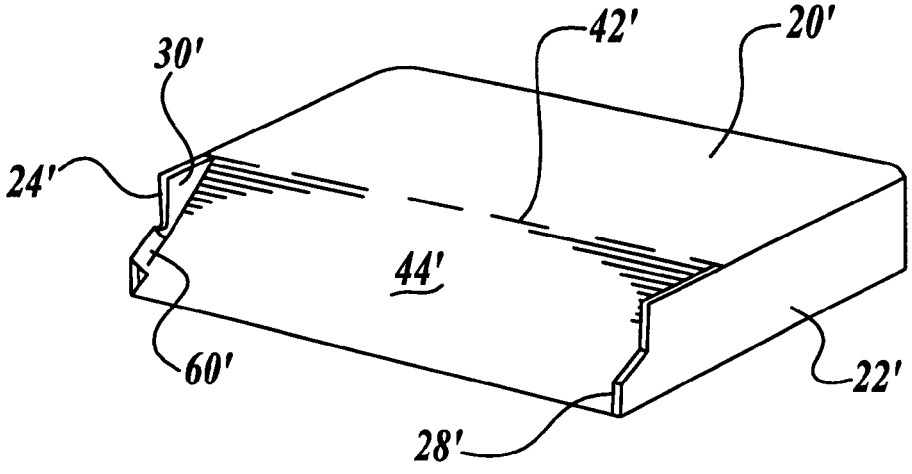
FIG. 7 is a perspective view of the container of FIG. 6 after being reduced in size in accordance with the present invention.
Figure 8:
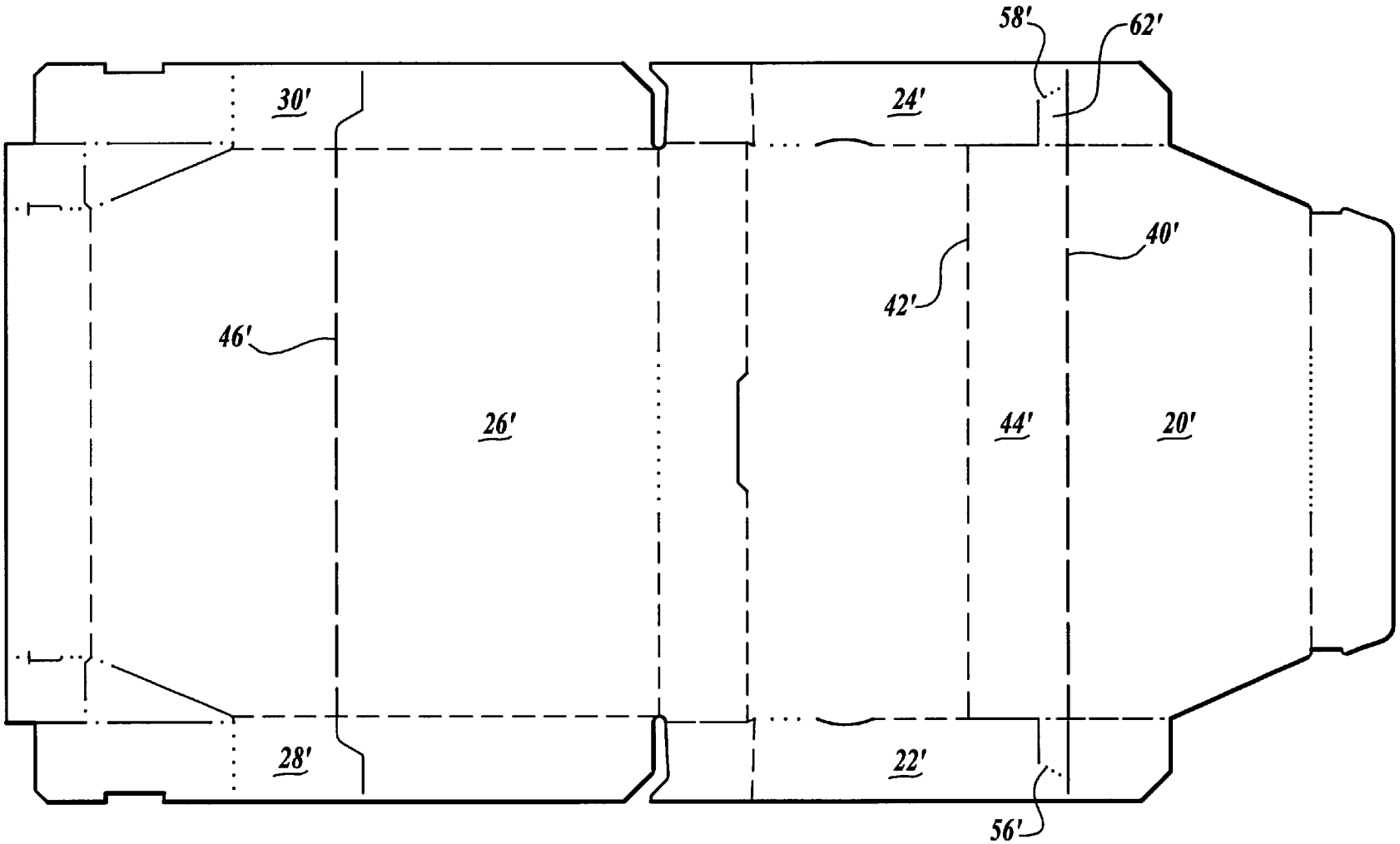
FIG. 8 is a plan view of the blank used to form the container in FIG. 6.
Figure 9:
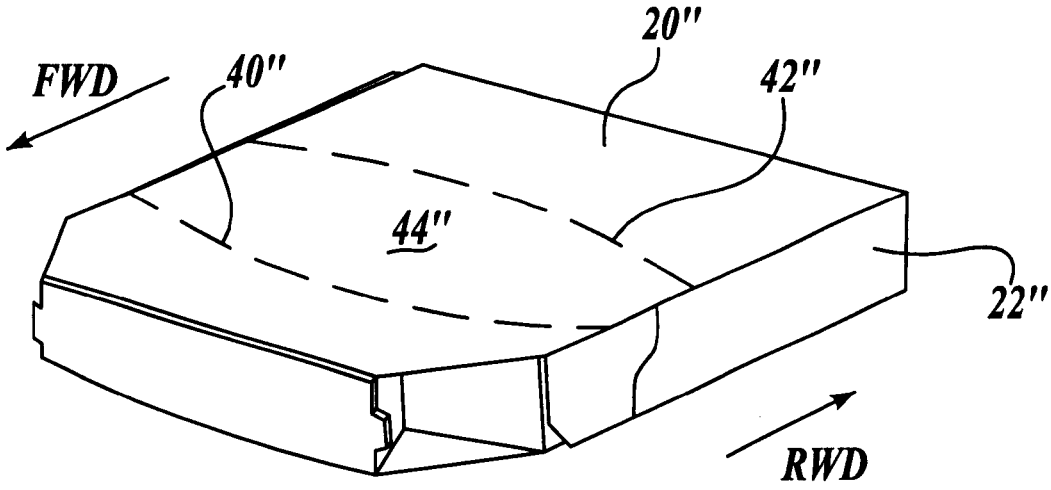
FIG. 9 is a perspective view of a third embodiment of a container formed in accordance with the present invention.
Figure 10:
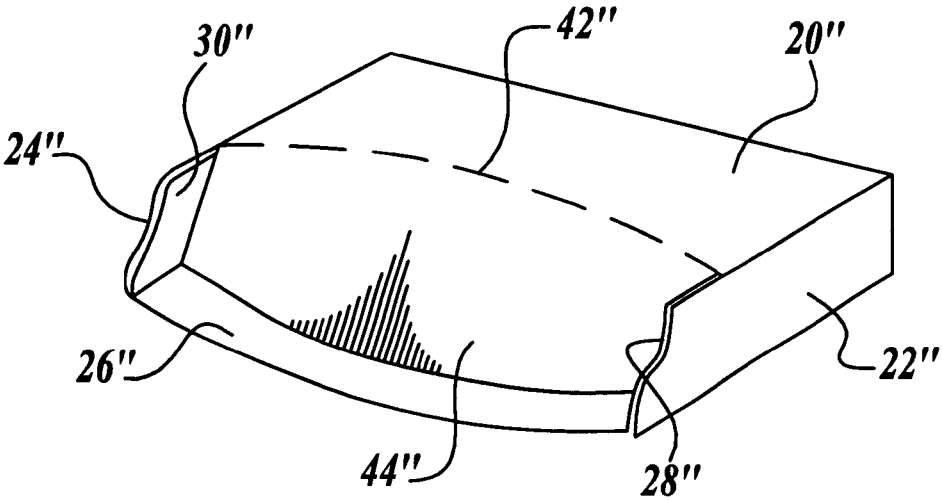
FIG. 10 is a perspective view of the container of FIG. 9 after being reduced in size according to the method of the present invention.
Figure 11:
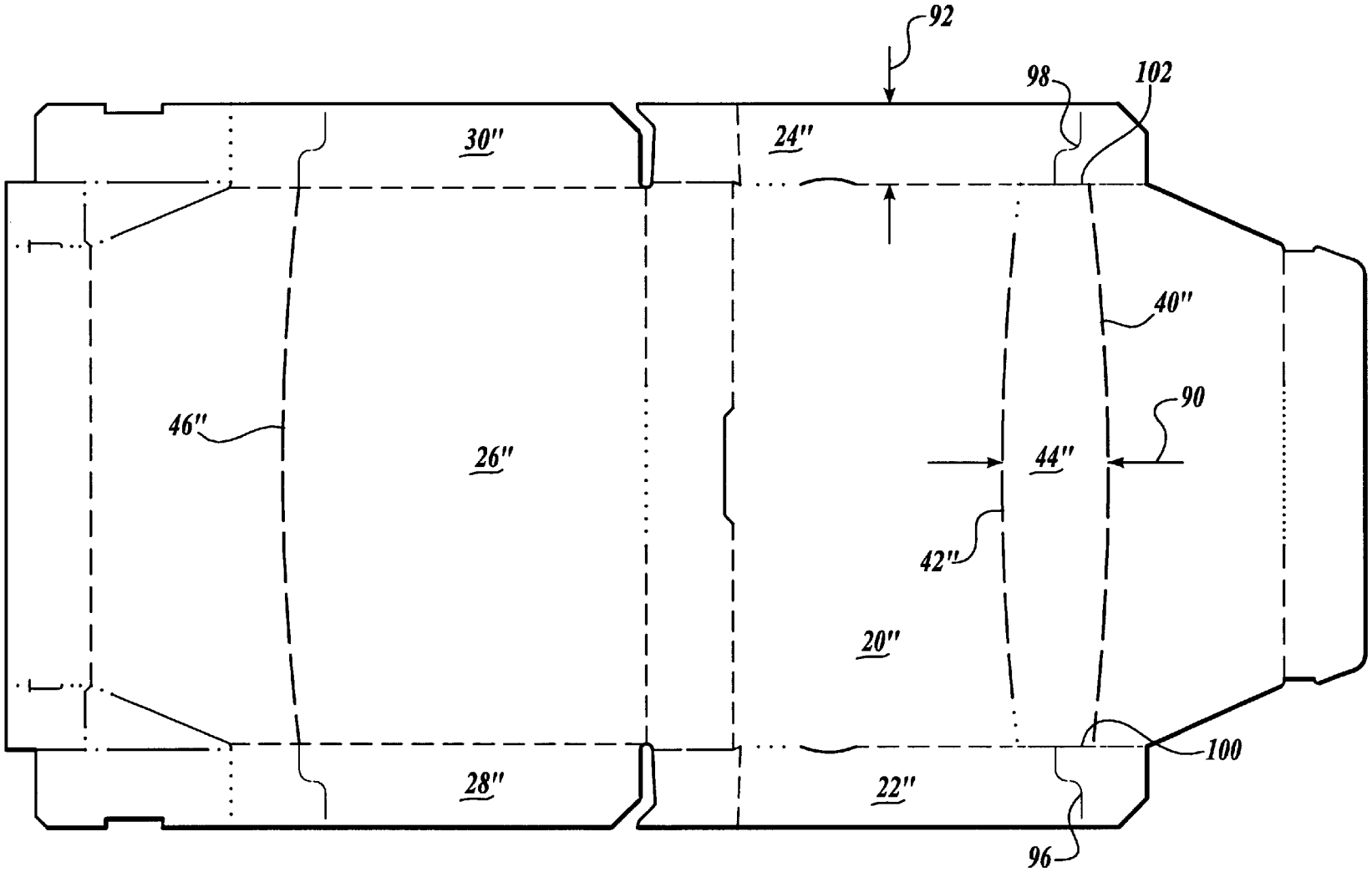
FIG. 11 is a plan view of the blank used to form the container in FIG. 9.

The present invention is an improvement to pizza-style paperboard containers, i.e., those that are generally flat and square in shape. Three embodiments of the present invention are described herein, however, numerous other embodiments may be formed according to the teachings of the present invention. FIGS. 1–5 illustrate a first embodiment; FIGS. 6–8 illustrate a second embodiment; and FIGS. 9–11 illustrate a third embodiment.

The present invention improvement may be applied to various types of known pizza cartons. The carton of FIGS. 1–5 has a fold-over front panel and upper side panels that insert inward of lower side panels as assembled. The carton of FIGS. 6–11 includes angled front corners, a slide-in top panel flap, and upper side panels that remain outward of lower side panels as assembled. As will be appreciated from a reading below, the present invention may be further applied to many other types of cartons. The relevant aspects of such cartons are described below.

Figure 1:
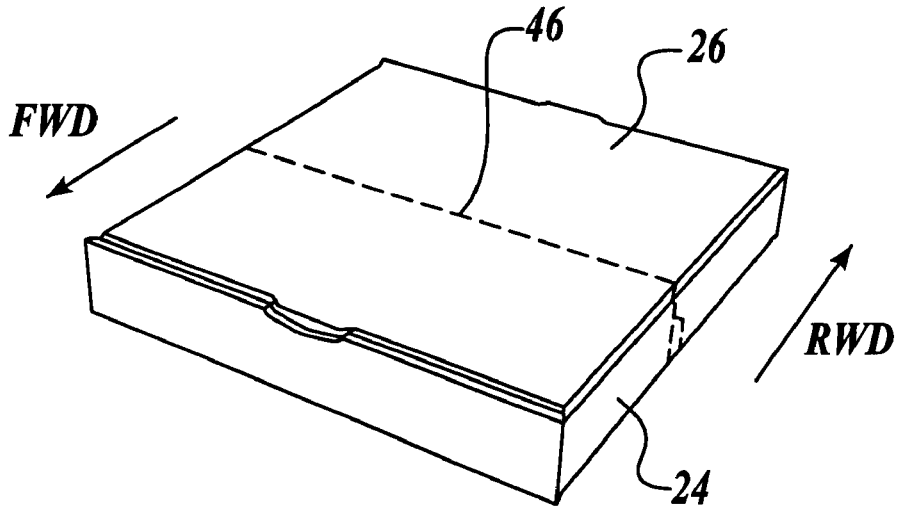
FIG. 1 is a perspective view of a first embodiment of a container formed in accordance with the present invention.
Figure 2:
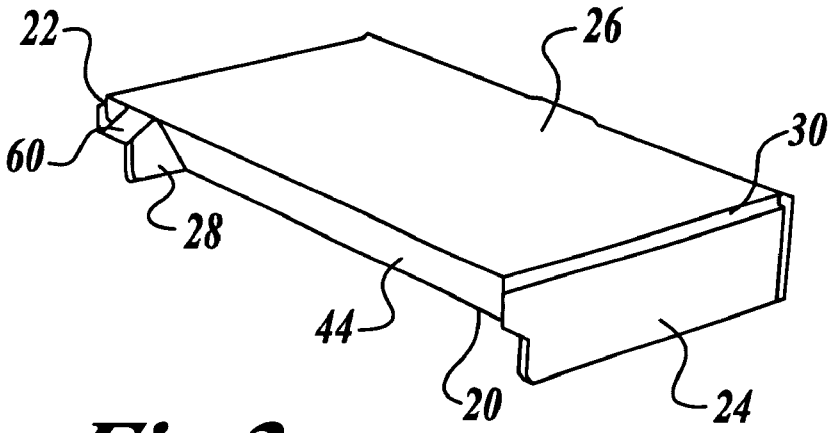
FIG. 2 is a perspective view of the container of FIG. 1 after being reduced in size in accordance with the present invention.
Figure 3:
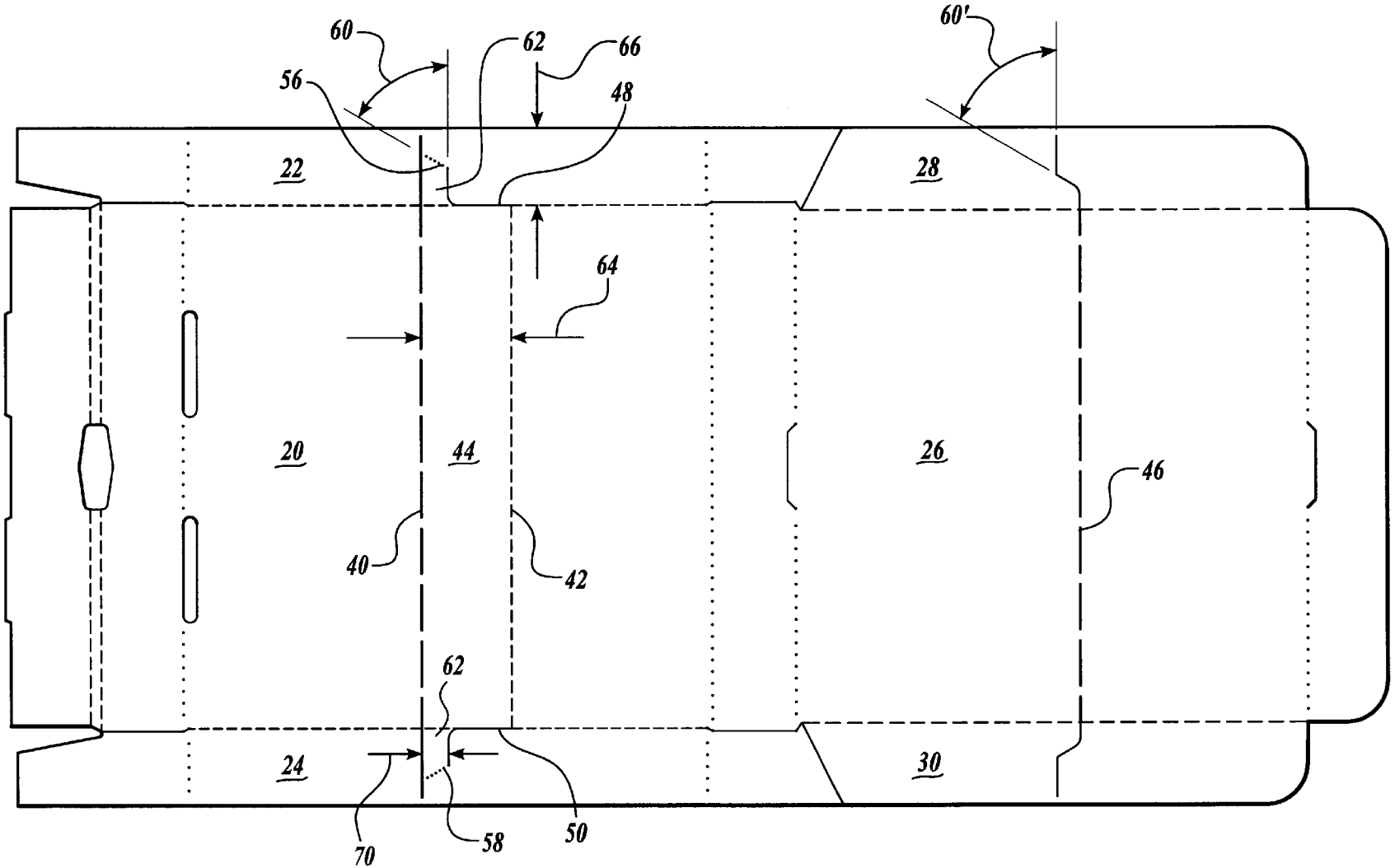
FIG. 3 is a plan view of the blank used to form the container in FIG. 1.
Figure 4B:
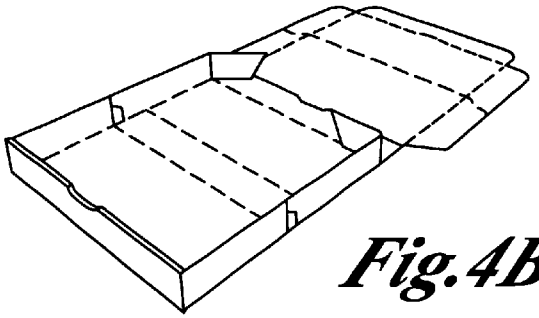
FIGS. 4A, 4B, 4C, and 4D are perspective views illustrating forming of the container of FIG. 1.
Figure 4D:
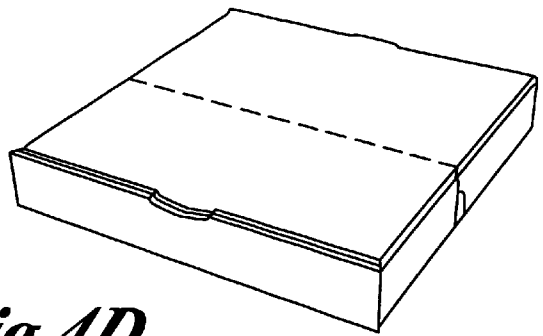
Figure 4A:
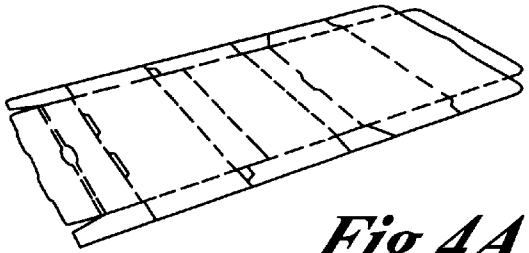
Figure 4C:
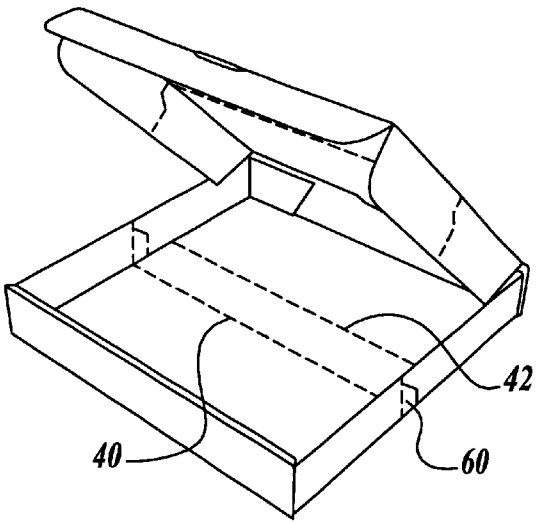

Referring to FIG. 3, the carton is preferably formed from a single-piece blank of corrugated paperboard material. The blank includes a first lateral panel 20 with first and second opposed side panels 22, 24 hingedly connected to opposed side edges of the first lateral panel. A second lateral panel 26 is provided with third and fourth opposed side panels 28, 30 hingedly connected to the second lateral panel side edges. The assembled container has a forward direction ("FWD") and a rearward direction ("RWD"), as indicated in FIGS. 1, 6, and 9. As assembled, the first and second lateral panels 20, 26 are generally parallel to one another, the side panels 22, 24, 28, 30 are orthogonal to the lateral panels, and the third and fourth side panels 28, 30 are adjacent and inward of the first and second side panels 22, 24, respectively In general, the present invention improvement is the pre-formation of various separation lines, fold lines, and cuts in the carton blank that allow a user to break the forward region of an assembled carton apart from its rearward region, thus effectively forming two separate carton halves. A flap is available to close off the opening formed by the separation. The present invention thus reduces an assembled container into a smaller-sized container in only a few, easy steps.

Referring still to FIG. 3, a first separation line 40 is provided in the first lateral panel 20 and its first and second side panels 22, 24. As shown, the line 40 is generally straight. A fold line 42 extends through the first lateral panel 20 at a location rearward of and parallel to the first separation line 40. The area between the first separation line 40 and the fold line 42 forms a closure flap 44. A second separation line 46 extends through the second lateral panel and its third and fourth side panels. The second separation line 46 has a straight shape in the second lateral panel 26 and a dog-leg shape in the third and fourth side panels 28, 30. As assembled, the first and second separation lines 40, 46 are generally vertically aligned with one another.

Still referring to FIG. 3, first and second cuts 48, 50 are provided in the first and second side panels 22, 24, respectively. Each cut extends forwardly along the hinged connection between the side panel and the first lateral panel 20 from the location of the pre-formed fold line 42 to a location rearward of the first separation line 40. The cuts then extend part way up the side panels. As shown, each cut thereby has two portions, one generally orthogonal to the other.

First and second hinge lines 56, 58 are formed in the first and second side panels 22, 24, respectively. Each hinge line 56, 58 extends from the end of the cut in the side panel to the first separation line in the side panel. The hinge lines 56, 58 are formed at a predefined angle 60. The area of the side panels bounded by the hinge line, the first separation line, and the vertical portion of the cut defines a single hinge 62. The dog-leg in the second separation line 46 at the third and fourth side panels 28, 30 are formed with a similar angle 60'.

In one embodiment, the portion of the first separation line 40 located in the first lateral panel 20 and the portion of the second separation line 46 located in the second lateral panel 26 are both formed using a ⅞ inch cut by ⅛ inch skip. The portions of the first separation line 40 that are located in the first and second side panels 22, 24 are formed using cuts, the outer portion of which is skipped by a small amount, e.g., 3⁄16 inch. The portions of the second separation line 46 that are located in the third and fourth side panels 28, 30 are formed using cuts, the outer portion of which is skipped by a small amount, e.g., 1⁄16 inch to 3⁄16 inch. The fold line 42 is formed using a ¼ inch cut by ¼ inch score.

The first and second cuts 48, 50 are formed as cuts, with a small curve used to transition between their orthogonal portions. The first and second hinge lines 56, 58 are formed as scores. The width of each hinge 62 is approximately ⅝ inch. The width of the corresponding portions in the third and fourth side panels 28, 30 are approximately 9⁄16 inch. The width 64 of the closure flap 44 is 2 and ⅛ inches, while the width 66 of the side panels is 1 and 13⁄16 inches.

Initial assembly of the blank is accomplished in a conventional manner as illustrated in FIGS. 4A–4D. The blank is laid horizontally, the lower side panels 22, 24 are folded upright, the upper lateral panel 26 is folded over the lower lateral panel 20, and the upper side panels 28, 30 are tucked inward of the lower side panels 22, 24. The various pre-formed lines do not affect or hinder the use of the assembled carton in any way.

After the food contents of the container are mostly consumed, the remaining food is slid rearward. Referring to FIGS. 5A–5D, the carton is reduced in size by breaking the container along the first and second separation lines 40, 46. This is most easily accomplished by placing the assembled container at the edge of a countertop or other hard surface, and quickly snapping the front portion of the carton downward. This motion breaks the carton along the separation lines, resulting in the reduced-size carton shown in FIG. 5B. The closure flap 44 is then folded along the fold line 42, while the first and second side panels 22, 24 are folded about their respective first and second hinge lines 56, 58. The dog-leg portions of the third and fourth side panels 28, 30 are thereby securely captured by the single hinges. See FIG. 5C. The reduced-size carton may be easily opened and re-shut using the remaining upper lateral panel as the new lid. See FIG. 5D.

Using basic geometry, a designer may select from various shapes, sizes, and locations of the cuts and hinge lines to design a particular final orientation of the closure flap 44. In general, a closure flap having a height 64 (see FIG. 3) greater than the side panel height 66 will result in the closure flap being oriented in a forwardly slanted direction, such as that shown in FIGS. 2, 7, and 10. In one embodiment, the closure flap is disposed at a non-vertical orientation. In another embodiment, the closure flap is disposed at an angle in the range of about 20° to about 40° relative to vertical. For example, the angle 68 in FIG. 5D is approximately 30°.

Alternatively, the angle 60 of the hinge line may be used to define the orientation of the closure flap. In one embodiment, the predefined angle of the first and second hinge lines is greater than 45° as measured from vertical. In another embodiment, the predefined angle of the first and second hinge lines is in the range of about 50° to about 70° as measured from vertical. In FIG. 3, the hinge angle is approximately 60°. The width 70 of the hinge itself may vary as well. In general, it should not be made too small, since repeated openings and closings will cause it to fracture. In one embodiment, the hinge is of a width in the range of about 0.50 inches to about 0.75 inches.

A second embodiment of the present invention is shown in FIGS. 6–8. In this embodiment, like parts are labeled using like numbers with the addition of a single apostrophe. In essence, the present invention described in FIGS. 1–5 is applied to a more modem pizza carton, with the various separation lines, folds, and cuts being applied oppositely. In particular and referring to FIG. 8, the upper lateral panel serves as the first lateral panel 20' and includes the closure flap 44'. The lower lateral panel is the second lateral panel 26' and includes side panels 28', 30' that insert inwardly of the upper side panels 22', 24'.

A third embodiment of the present invention is shown in FIGS. 9–11, with previously described parts being labeled with like numbers and double apostrophe. In this embodiment, the hinge may be eliminated and the closure flap made to frictionally engage the second lateral panel. As above, this improvement may be applied to numerous types of known cartons and may be accomplished on either the upper or lower lateral panels.

Referring to FIG. 11, a first separation line 40" extends through the first lateral panel 20". The first separation line includes portions forwardly arcuate in shape. In FIG. 9, the entire first separation line has a forwardly arcuate shape. A fold line 42" extends through the first lateral panel at a location rearward of the first separation line. The area therebetween forms a closure flap 44". The fold line 42" is rearwardly arcuate in shape. (See FIG. 9.) The closure flap 44" has a maximum height 90 generally greater than the height 92 of the side panels. A second separation line 46" extends through the second lateral panel 26" and its third and fourth side panels 28", 30". The second separation line 46" may also be formed with a forwardly arcuate shape. As assembled, the first and second separation lines 40", 46" are generally vertically aligned with one another.

Third and fourth separation lines 96, 98 extend in the first and second side panels 22", 24", respectively, at a location generally forward of the fold line 42". In one embodiment, the side panel separation lines have similar dog-leg shapes. First and second cut lines 100, 102 are formed along the hinged connection between the first lateral panel 20" and the first and second side panels 22", 24". The cut lines 100, 102 extend from the fold line 42" to at least the first separation line 40".

To reduce the assembled container into a smaller-sized container, the user breaks the assembled container along the separation lines 44", 46" and the closure flap 44" is folded along the fold line 42". The portions of the closure flap having a forwardly arcuate shape frictionally engage the second lateral panel 26", while portions of the third and fourth side panels 28", 30" are captured between the side edges of the closure flap and the first and second side panels 22", 24", respectively.

In one embodiment, the fold line 42" is formed using a ½ inch cut by ¼ inch score. The radius of curvature for each of the curved separation and fold lines 40", 46", 42" is 49.193 inches. The third and fourth separation lines 96, 98 are cuts and include a small middle portion that is skipped (e.g., about 1/16 inch) and a small outer portion that is skipped (e.g., about 3/16 inch). The length of the first and second cuts 100, 102 is 1.5 inches. The maximum width of the closure flap 44" is 2.339 inches. The width 92 of the side panels is 1.75 inches.

While the preferred embodiment of the invention has been illustrated and described, it will be appreciated that various changes can be made therein without departing from the spirit and scope of the invention. For example, as would be known to those skilled in the art, the various lines described above may be made using different types of scores.

The embodiments of the invention in which an exclusive property or privilege is claimed are defined as follows:

1. In a pizza-style paperboard container formed from a single-piece blank including a first lateral panel, first and second opposed side panels hingedly connected to the first lateral panel, a second lateral panel, and third and fourth opposed side panels hingedly connected to the second lateral panel; the container having a forward direction and a rearward direction; as assembled, the first and second lateral panels being parallel to one another, the side panels being orthogonal to the lateral panels, and the third and fourth side panels being adjacent and inward of the first and second side panels; an improvement for reducing the assembled container into a smaller-sized,container, the improvement comprising:

(a) a first separation line extending through the first lateral panel and its first and second side panels;

(b) a fold line extending through the first lateral panel at a location rearward of the first separation line; the area therebetween forming a closure flap;

(c) a second separation line extending through the second lateral panel and its third and fourth side panels; the second separation line having a straight shape in the second lateral panel and having a dog-leg shape in the third and fourth side panels; as assembled, the first and second separation lines being generally vertically aligned with one another;

(d) first and second cuts in the first and second side panels, respectively; each cut extending forwardly along the hinged connection between the side panel and the first lateral panel from the location of the pre-formed fold line to a location rearward of the first separation line, the cut then extending part way up the side panel;

(e) first and second hinge lines formed in the first and second side panels, respectively; each hinge line extending from the end of the cut in the side panel to the first separation line in the side panel; the hinge lines being formed at a predefined angle; the area of the side panels bounded by the hinge line, the first separation line, and the vertical portion of the cut defining a single hinge;

wherein to reduce the assembled container into a smaller-sized container, the user breaks the container along the first and second separation lines, the closure flap is folded along the fold line while the first and second side panels are folded about their respective first and second hinge lines, the dog-leg portion of the third and fourth side panels being captured by the single hinges.

2. The improvement according to claim 1, wherein the predefined angle of the first and second hinge lines is greater than 45° as measured from vertical.

3. The improvement according to claim 1, wherein the predefined angle of the first and second hinge lines is in the range of about 50° to about 70° as measured from vertical.

4. The improvement according to claim 1, wherein the hinge is of a width in the range of about 0.50 inches to about 0.75 inches.

5. The improvement according to claim 1, wherein as reduced and closed, the closure flap is disposed at a non-vertical orientation.

6. The improvement according to claim 5, wherein as reduced and closed, the closure flap is disposed at an angle in the range of about 20° to about 40° relative to vertical.

7. The improvement according to claim 5, wherein as reduced and closed, the first separation line at the closure flap is located forward of the fold line.

8. The improvement according to claim 5, wherein the height of the closure flap is generally greater than the height of the side panels.

9. The improvement according to claim 8, wherein the height of the closure flap is in the range of about 15% to about 20% greater than the height of the side panels.

10. The improvement according to claim 1, wherein the first and second cuts in the first and second side panels are formed as through cuts with an outer portion skipped.

11. The improvement according to claim 1, wherein the first and second separation lines are formed using a ⅞ inch cut by ⅛ inch score.

12. The improvement according to claim 1, wherein the fold line is formed as ¼ inch cut by ¼ inch score.

13. In a pizza-style paperboard container formed from a single-piece blank including a first lateral panel, first and second opposed side panels hingedly connected to the first lateral panel, a second lateral panel, and third and fourth opposed side panels hingedly connected to the second lateral panel; the container having a forward direction and a rearward direction; as assembled, the first and second lateral panels being parallel to one another, the side panels being orthogonal to the lateral panels, and the third and fourth side panels being adjacent and inward of the first and second side panels; an improvement for reducing the assembled container into a smaller-sized container, the improvement comprising:

(a) a first separation line extending through the first lateral panel;

(b) a fold line extending through the first lateral panel at a location rearward of the first separation line; the area therebetween forming a closure flap; the fold line being rearwardly arcuate in shape; the closure flap having a maximum height generally greater than the height of the side panels;

(c) a second separation line extending through the second lateral panel and its third and fourth side panels; in the second lateral panel, the second separation line having a portion with a forwardly arcuate shape; as assembled, the first and second separation lines being generally vertically aligned with one another;

(d) third and fourth separation lines extending in the first and second side panels, respectively, at a location generally forward of the fold line;

(e) first and second cut lines formed along the hinged connection between the first lateral panel and the first and second side panels respectively, the cut lines extending from the fold line to at least the first separation line;

wherein to reduce the assembled container into a smaller-sized container, the user breaks the container along the separation lines and the closure flap is folded along the fold line; the portions of the closure flap having a forwardly arcuate shape frictionally engaging the second lateral panel, while portions of the third and fourth side panels are captured between the edges of the closure flap and the first and second side panels, respectively.

14. The improvement according to claim 13, wherein the first separation line includes portions forwardly arcuate in shape.

15. The improvement according to claim 13, wherein the first and second separation lines are wholly forwardly arcuate in shape.

16. The improvement according to claim 15, wherein the curve of the first and second separation lines and the fold line is formed using a radius in the range of about 48 inches to about 50 inches.

17. The improvement according to claim 13, wherein the side panel separation lines have similar dog-leg shapes.

18. The improvement according to claim 13, wherein the third and fourth separation lines are formed as cuts with a small middle portion skipped.

* * * * *